United States Patent [19]

Bichsel et al.

[11] 4,263,052

[45] Apr. 21, 1981

[54] PRODUCTION OF FRUCTOSE AND USEFUL BY-PRODUCTS

[75] Inventors: Stanley E. Bichsel, Fargo, N. Dak.; Yueh Wang, Eagan; Andrew M. Sandre, Moorhead, both of Minn.

[73] Assignee: American Crystal Sugar Company, Moorhead, Minn.

[21] Appl. No.: 84,178

[22] Filed: Oct. 12, 1979

[51] Int. Cl.[3] ..... C13K 3/00

[52] U.S. Cl. ..... 127/41; 127/36; 127/46 A; 127/47; 127/48; 426/807; 435/99

[58] Field of Search ..... 127/41, 47, 48, 36; 435/94, 99, 803

[56] References Cited

U.S. PATENT DOCUMENTS

| | | | |
|---|---|---|---|
| Re. 21,498 | 6/1940 | Wadsworth . | |
| 710,413 | 10/1902 | Besson . | |
| 1,573,733 | 2/1926 | Morse . | |
| 1,699,449 | 1/1929 | Ray . | |
| 1,746,994 | 2/1930 | Denny . | |
| 2,007,971 | 7/1935 | Jackson . | |
| 2,018,869 | 10/1935 | Olivarius . | |
| 2,227,813 | 1/1941 | Roland . | |
| 2,337,853 | 12/1943 | Jurgensen . | |
| 2,354,664 | 8/1944 | Cantor . | |
| 2,362,357 | 11/1944 | Cummins . | |
| 2,381,090 | 8/1945 | Vincent . | |
| 2,402,960 | 7/1946 | Gustafson . | |
| 2,408,418 | 10/1946 | Erickson . | |
| 2,416,682 | 3/1947 | Erickson . | |
| 2,421,376 | 6/1947 | Erickson . | |
| 2,470,332 | 5/1949 | Bollaert . | |
| 2,534,560 | 12/1950 | Shafor . | |
| 2,588,449 | 3/1952 | Young . | |
| 2,668,128 | 2/1954 | Oxnard . | |
| 2,729,587 | 1/1956 | Koepsell . | |
| 2,813,810 | 11/1957 | Smith . | |
| 2,949,389 | 8/1960 | Murtaugh . | |
| 3,044,904 | 7/1962 | Serbia . | |
| 3,044,905 | 7/1962 | Lefevre . | |
| 3,050,444 | 8/1962 | Holstein . | |
| 3,098,766 | 7/1963 | Payet . | |
| 3,194,682 | 7/1965 | Tippens . | |
| 3,256,270 | 6/1966 | Haack . | |
| 3,290,173 | 12/1966 | Marino . | |
| 3,298,865 | 1/1967 | Bode . | |
| 3,306,752 | 2/1967 | Ueda . | |
| 3,340,093 | 9/1967 | Cortis-Jones . | |
| 3,416,961 | 12/1968 | Mountfort . | |
| 3,483,031 | 12/1969 | Lauer . | |
| 3,567,512 | 3/1971 | Lyons . | |
| 3,666,647 | 5/1972 | Kubo . | |
| 3,671,316 | 6/1972 | Tatuki . | |
| 3,806,363 | 4/1974 | Takasaki . | |
| 3,812,010 | 5/1974 | Nitsch | 435/105 X |
| 3,832,284 | 8/1974 | Suzuki | 435/276 X |
| 3,909,287 | 9/1975 | Rundell . | |
| 4,040,906 | 8/1977 | Uchio | 435/144 |
| 4,081,288 | 3/1978 | Torres . | |
| 4,133,696 | 1/1979 | Barker . | |

*Primary Examiner*—Sidney Marantz

*Attorney, Agent, or Firm*—Merchant, Gould, Smith, Edell, Welter & Schmidt

[57] ABSTRACT

A process for obtaining fructose solutions or solid fructose, a raw material containing sucrose and/or similar fructofuranosides is hydrolyzed to fructose and glucose and treated with a calcium base (e.g. calcium oxide or hydroxide) to precipitate calcium-sugar complexes. The precipitate is slurried in water and then treated with phosphoric acid to liberate (e.g. at a pH of 5.5 to 9) a fructose solution of high purity (i.e. de-complex the calcium-fructose complex), with precipitation of useful calcium phosphate salts. Phosphoric acid has been found to have significant advantages over carbonic acid or carbon dioxide as the fructose-liberating (de-complexing) agent, e.g. better yields and more useful by-products. Solid fructose can be obtained from the fructose solution in a known manner. The filtrate from the calcium-sugar complexing step can be acidified to yield stable, useful, fructose-depleted by-products.

12 Claims, 1 Drawing Figure

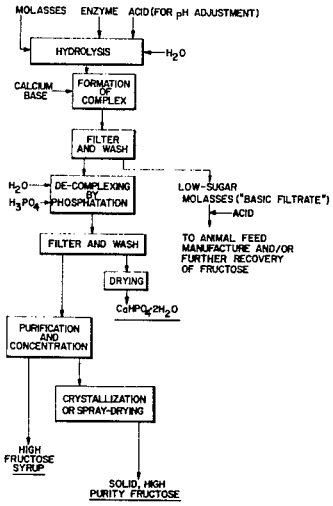

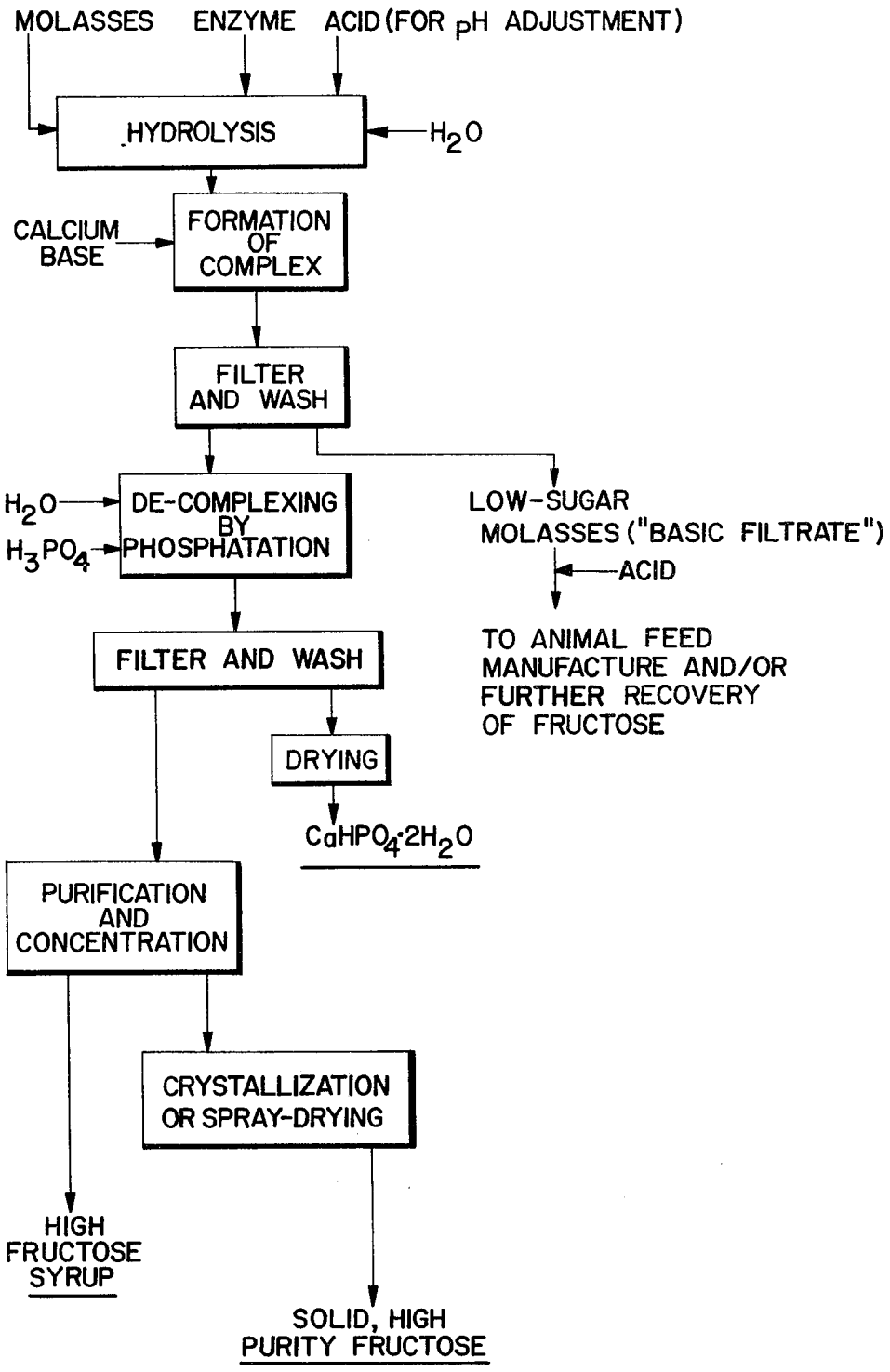
MOLASSES
ENZYME
ACID (FOR pH ADJUSTMENT)
HYDROLYSIS
$H_2O$
CALCIUM BASE
FORMATION OF COMPLEX
FILTER AND WASH
$H_2O$
$H_3PO_4$
DE-COMPLEXING BY PHOSPHATATION
LOW-SUGAR MOLASSES ("BASIC FILTRATE")
ACID
TO ANIMAL FEED MANUFACTURE AND/OR FURTHER RECOVERY OF FRUCTOSE
FILTER AND WASH
DRYING
$CaHPO_4 \cdot 2H_2O$
PURIFICATION AND CONCENTRATION
CRYSTALLIZATION OR SPRAY-DRYING
HIGH FRUCTOSE SYRUP
SOLID, HIGH PURITY FRUCTOSE

PRODUCTION OF FRUCTOSE AND USEFUL BY-PRODUCTS

BACKGROUND OF THE INVENTION

This invention relates to a process for obtaining fructose and other useful products from starting materials containing the fructose moiety or monomeric unit, e.g. sucrose-containing or other saccharides, especially of the fructofuranoside type. An aspect of this invention relates to a method for separating fructose and glucose when these sugars are obtained by hydrolysis of such starting materials. A further aspect of this invention relates to various chemical precipitation steps useful for separating the monosaccharide hydrolysis products from each other.

Many research studies have reported that fructose is sweeter than sucrose (ordinary sugar). According to Shallenbeiger et al, SUGAR CHEMISTRY, page 116 (1975), the AVI Publishing Company, Inc., crystalline fructose is 1.8 times sweeter than sucrose. Accordingly, fructose is fast becoming one of the most popular candidates for sweetening foods and beverages—its greater sweetening power making possible a significant reduction in the caloric intake of the food or beverage consumer. In recent years, a number of synthetic sweeteners have come under close scrutiny as a result of experiments indicating carcinogenic activity in experimental animals; hence, the purely "natural" route to lower calorie intake offered by fructose sweetening has acquired even greater significance. Indeed, some researchers claim a variety of physiological benefits can be obtained by including fructose in the diet.

Fructose (also called "levulose" in some of the earlier scientific literature) is widely distributed in nature. In addition, several readily available materials such as enzymatically derived and isomerized corn syrup and honey can contain significant amounts of this sugar. Nevertheless, in many aspects of the industrial practice of manufacturing pharmaceuticals, foods, beverages, dietary supplements, and the like, these various relatively low fructose-content sugars (typically 42 to 55% fructose) are not preferred. One somewhat more preferred form is a "high fructose syrup", i.e. a relatively concentrated aqueous solution of substantially pure fructose or fructose mixed with minor amounts of other carbohydrates, which can, if desired, by crystallized to directly obtain substantially pure crystalline fructose.

Much of the crystalline fructose produced for today's market is obtained from raw materials containing a mixture of sugars. The fructose is separated from the mixture and purified using techniques such as ion exchange and chromatography. Another technique, less widely used, involves chemical precipitation of fructose with alkaline earth metal complexes. This technique takes advantage of the fact that fructosate complexes are less soluble in water than, for example, the corresponding glucosates. Still another approach to the manufacture of fructose involves isomerization of monosaccharide isomers such as glucose, e.g. with sodium aluminate or the enzyme of glucose isomerase.

At first glance, the chemical precipitation technique (whereby alkaline earth metal cations form complexes with the sugars in the sugar mixture) would appear to be very promising. The disaccharide sucrose can be considered to be an equimolar combination of glucose and fructose, since acid or enzymatic hydrolysis of the sucrose molecule can provide an equimolar mixture of these two monosaccharides (in any of their isomeric forms). A very promising aspect of this process stems from the very high level of availability of sucrose, not only in pure form, but also in impure sugar-bearing liquors, juices and various by-product forms such as molasses. Apparently, significant progress in the utilization of the chemical precipitation technique for separating fructose from glucose was hindered by the stability of the alkaline earth metal fructose complex under cold conditions. Various acids will break up this complex and release the fructose, the most common of these being carbonic acid. Both beet sugar and cane sugar manufacturing facilities, typically, have an ample source of relatively pure carbon dioxide available; so carbonic acid has traditionally been considered to liberate fructose from the generally water insoluble complexes (e.g. calcium fructosate). See, for example, U.S. Pat. No. 2,007,971 (Jackson), issued July 16, 1935, particularly page 3, line 31 et seq. As noted by Jackson, the carbon dioxide as carbonic acid causes a precipitation of calcium carbonate and releases fructose to the aqueous medium. The calcium carbonate precipitate can then be removed by filtration.

The results of this carbonic acid precipitation technique have apparently not met modern industry standards for the production of relatively pure fructose. For example, even at low temperature, a considerable amount of color bodies tend to form prior to or during or even subsequent to the liberation of the fructose from the fructosate complex, meaning destruction of the fructose molecule. In many large scale uses of fructose (or sugars generally), a clear solution or a pure white powder or crystal is desirable or even essential for consumer acceptance or for satisfying industry-imposed quality control standards. Consequently, these color bodies must be removed—or their formation avoided. Furthermore, whenever one is dealing with fructose and glucose, it is necessary to take into account their pH and heat sensitivity; the heat produced by exothermic reaction may be sufficient to accelerate degradation of these rather sensitive sugar products.

SUMMARY OF THE INVENTION

It has now been found that the liberation of fructose from a calcium-fructose complex can be carried out with surprising efficiency and in excellent yield at relatively low temperatures, with a minimum of undesirable side reactions and the like, using phosphoric acid as the agent for breaking up the complex. Presently available data indicate, for example, that yields of fructose obtained according to the teachings of this invention are significantly improved when compared to the carbonic acid technique, reaction times and color formation are less, and colorants are more easily removed.

In short, this invention involves a process for obtaining either solid fructose or aqueous fructose solutions from a fructofuranoside-containing starting material (e.g. a material containing saccharides of the fructofuranoside type), whereby:

(a) the saccharide is hydrolyzed to provide a mixture of glucose and fructose;

(b) a basic calcium compound is added to precipitate a mixture of calcium-sugar complexes which will comprise primarily the calcium-fructose complex;

(c) the calcium-fructose complex thereby obtained is treated with phosphoric acid in an aqueous reaction medium under temperature conditions sufficiently cool to provide a high quality product in high yield; and (d) fructose of relatively high purity is obtained from this reaction medium.

At least initially, it is more convenient to obtain the fructose in the form of an aqueous sugar solution. The impure fructose solution can then be deashed using deionization or some similar technique. Solid fructose can be obtained from the solution by known crystallization techniques, spray drying, or the like. Alternatively, the fructose solution after concentration can find application in some industries. The ultimately obtained solid product or the solids in the sugar solution can comprise at least 85 weight-% fructose, and a fructose content of 90 weight-% or more is obtainable in practice.

When beet or cane molasses is used as the starting material for the production of fructose according to this invention, the relatively high protein residue is a useful by-product, a typical application being in the field of animal feed manufacture. It is perhaps of equal or even greater importance that the by-product of the reaction between the calcium-fructose complex and the phosphoric acid is a calcium phosphate precipitate commonly used in the cattle feed industry. One phosphate precipitate which is favored by the reaction conditions is calcium hydrogen phosphate and its hydrate salts, e.g. $CaHPO_4.2H_2O$, also known as dibasic calcium phosphate or "dicalcium phosphate" or "dical".

BRIEF DESCRIPTION OF THE DRAWING

The Drawing is a somewhat simplified flow sheet representing a preferred process of this invention.

DETAILED DESCRIPTION

As noted previously, several important advantages of this invention stem from the use of phosphoric acid as the agent for liberating fructose from the calcium-fructose complex. The reasons for the superiority of phosphoric acid are not all fully understood, since the nature of calcium-monosaccharide complexes and the reactions which produce them have not been fully elucidated. It is known, as pointed out previously, that treatment with carbonic acid breaks up the calcium-fructose (or "calcium fructosate") complex, liberating the fructose. The equilibrium for the de-complexing reaction is shifted in favor of fructose liberation due to the formation of a substantially insoluble salt of calcium; in the case of carbonic acid, this salt is calcium carbonate.

Rendleman, in ADV. IN CARBOHYDRATE CHEMISTRY AND BIOCHEMISTRY, 24:209 (1966), proposes a structure for carbohydrate complexes. If one assumes that the hydroxyl groups of the carbohydrate are weakly acidic, it is reasonable to suppose that a basic metal oxide or hydroxide can complex with a carbohydrate molecule directly through the hydroxyl groups, whereby the ligand contains one or more oxy groups (—O—). Continuing with this line of reasoning, the calcium complex of a $C_6$ sugar could be $CaC_6H_{10}O_6$ or $C_6H_{11}O_6.Ca(OH)$. Either of these complexes could contain a relatively stable

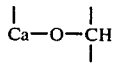

linkage. A third possibility would be the relatively weak complex, $C_6H_{12}O_6.Ca(OH)_2$. In any event, it should be noted that this invention is not bound by any theory. Empirical evidence suggests that about 1.5–2.5 moles of calcium ion in the form of a calcium base (e.g. CaO or $Ca[OH]_2$) are required for the precipitation of one mole of fructose. The resulting calcium/fructose complex is far less water soluble than the calcium/glucose complex. According to Rendleman, in "Ionization of Carbohydrates in the Presence of Metal Hydroxides and Oxides", CARBOHYDRATES IN SOLUTION, ACS, Washington, D.C. (1973), the hydroxyl groups of fructose have a pK of 12.03° at 25° C., while those of glucose have a pK of 12.35 at the same temperature. Again, this invention is not bound by any theory, but it would appear that the proton dissociation in fructose is higher than in glucose, thus providing a more efficient build-up of Ca-fructosate. If this theory is correct, the aforementioned calcium-deprotonated carbohydrate structure (as compared to the weak glucose complex $C_6H_{12}O_6.Ca[OH]_2$) has one major benefit and one major disadvantage. The major benefit is that this relatively stronger complex is less water soluble, thereby facilitating separation of the "fructosate" from the relatively more water soluble "glucosate". The major disadvantage is that the fructosate would be harder to break up; that is, the fructose would be harder to liberate from the complex.

Experiments indicate that the average recovery of fructose from "inverted molasses" (molasses containing hydrolyzed sucrose) using chemical precipitation with a calcium base followed by carbonation to liberate fructose is approximately 70%. The efficiency of the carbonation reaction could be increased by using higher fraction temperatures, but the risk of unacceptable levels of color formation or degradation of the product is also significantly increased. Furthermore, maximum calcium carbonate precipitation takes place at a highly alkaline pH range which, it is believed, leads to significant alkaline decomposition of fructose. When phosphoric acid is used to liberate fructose from the calcium fructosate, an average gain in yield of approximately 10–15% is obtained from a 20 Brix inverted molasses, at low temperatures (e.g. below 25° C.); phosphoric acid is added until a pH of 5.5–9 is obtained. In short, the phosphoric acid de-complexing or phosphatation step is surprisingly efficient under conditions so mild as to minimize fructose destruction and other undesirable effects. Perhaps equally surprising, the coloration of the product is less using phosphatation as compared to carbonation even under essentially the same mild temperature conditions.

The basic filtrate from the reaction medium in which the calcium fructosate was formed (hereinafter referred to as "the basic filtrate") does contain some dissolved fructose in one form or another, along with glucose or calcium glucosate. With further processing, fructose can be recovered from this filtrate also, thereby increasing the overall recovery of fructose from hydrolyzate (e.g. from inverted molasses) to more than 80%, e.g. 90 to 95% by weight, based upon the amount of fructose in the hydrolyzate. However, the "basic filtrate" is a useful protein-rich, high glucose, low-fructose molasses, to be used in animal feeds with a minimum of further processing, and this practice is presently preferred.

The chemical reaction which liberates the fructose is exothermic. It may be described by the previously outlined theory where the phosphoric acid facilitates restoring the "lost" proton or protons on the fructose ligand, thereby regenerating fructose and restoring its water solubility while, at the same time, forming an insoluble calcium phosphate salt such as $CaHPO_4$ $Ca_3(PO_4)_2$ or their hydrates. In short, the phosphoric acid de-complexing reaction could resemble a hydrolysis of a covalent calcium salt (or alcoholate) of a weak acid (or polyol). There is evidence supporting the hydrolysis analogy in the lack of a strict stoichiometric relationship between the equivalents of aqueous $H_3PO_4$ employed and the amount of fructose liberated. (A better way to determine the amount of $H_3PO_4$ needed is to determine a suitable target pH and add sufficient acid until this pH is reached.) In any event, this analogy to the hydrolysis of a strong base/weak acid covalent salt is offered for theoretical understanding only, and this invention is not bound by any theory. Regardless of the mechanism of the reaction, an important calcium phosphate precipitate is calcium hydrogen phosphate dihydrate, $CaHPO_4.2H_2O$, which is a commercially useful source of calcium and phosphorous (e.g. as a phosphate additive to cattle feed). The yield of such commercially useful salts are, according to this invention, very close to theoretical, e.g. more than 90%.

Thus, in the typical practice of this invention, diluted beet or cane molasses contained sucrose is enzymatically inverted to fructose and glucose. Fructose is selectively precipitated by the addition of lime as calcium fructosate. The insoluble calcium fructosate is repulped and the fructose rendered soluble by precipitation of the insoluble dicalcium phosphate through addition of phosphoric acid under cold reaction conditions. The precipitated dicalcium phosphate is removed by vacuum drum filtration. The filtrate containing fructose at an estimated 80% recovery and a maximum of 5% glucose is polish filtered, deashed using deionization, concentrated treated with granular carbon, polish filtered, and sold directly or utilized for the production of crystalline fructose.

The process steps and materials used in the process of this invention will now be considered in detail.

STARTING MATERIAL

The preferred starting material for the process of this invention contains at least some sucrose $C_{12}H_{22}O_{11}$, which occurs most prominently in sugar cane and sugar beets. Some of these preferred starting materials (e.g. molasses) also contain other fructofuranosides which can contain more than 12 carbons, e.g. raffinose. For the purposes of this disclosure, sucrose can be considered to be the condensation product of one mole of fructose with one mole of glucose resulting in the elimination of one mole of water. (Replacement of this mole of water, i.e. hydrolysis, regenerates the essentially equimolar mixture of the two monosaccharide sugars.) Although a pure sucrose solution would be an excellent starting material for the process of this invention, significant economic advantages are obtained when the sucrose is supplied to the process in the form of a by-product of the cane or beet sugar industry. Perhaps one of the most readily available by-products of these industries is the viscous liquid substance known as "molasses", which typically contains a significant amount of dissolved sucrose. The economic advantages of molasses are several. First, it is a by-product of the beet and cane industries and hence is relatively inexpensive compared to pure sucrose solutions. Second, the molasses does not contain any materials which would have a significantly adverse effect upon the process of this invention. Third, a major residue of the process, so to speak, is a low-fructose molasses which is suitable as is for use in animal feeds (e.g. ruminant feeds) and hence commercially saleable without complicated up-grading or modification. The "loss" of the fructose moiety from the sucrose content of the molasses generally has no adverse effect upon the commercial value of the molasses as a cattle feed; indeed, the relatively low protein content of the molasses is, for a variety of reasons, enhanced by the removal of the fructose moiety (provided, of course, that the low-fructose, high glucose molasses is sold in a sufficient state of concentration). As a result, the fructose obtained from molasses can be considered to have a zero or near-zero raw material cost effect (as a cattle feed), the primary cost factors stemming from the processing and the cost of reagents used to isolate the fructose from the original starting material.

"Molasses" is typically defined as the syrupy mother liquid left after the major amount of sucrose has been removed from the sugar cane or sugar beet juice. Many varieties of molasses are available with different sugar contents and impurities depending upon the stage at which the molasses is removed as a by-product stream. This can be a slight disadvantage, but not a significant one, in the context of this invention.

In some branches of the sugar production industry, efforts are made to recover additional sucrose from molasses. Nevertheless, the point at which further sucrose removal becomes uneconomical may be reached even when considerably less than 90% of the sucrose has been taken out. For example, blackstrap molasses from sugar cane can contain as much as 30% sucrose and beet sugar molasses up to 60% sucrose. For any type of molasses, however, its value as a raw material for the animal feed industry can be enhanced in terms of protein content by the extraction of fructose according to the process of this invention. All forms of molasses have in common the presence of a significant amount of sucrose (e.g. 30–60 weight-%); this amount is in most cases sufficient for the economical practice of this invention.

In addition to consideration of molasses as a raw material for the recovery of fructose high fructose corn syrups of the 45 to 55% fructose type may also be utilized as a raw material for fructose production.

The Hydrolysis Step

The first important step in the process of this invention is to convert polysaccharides (e.g. sucrose) in the starting material to monosaccharides by hydrolysis, the products typically comprising a roughly equimolar mixture of fructose and glucose, both of which have the formula $C_6H_{12}O_6$ and the formula weight of approximately 180. Thus, in a sense, glucose and fructose can be considered to be isomers. When represented in an open-chain form, fructose is a 2-ketohexose (the only common natural ketohexose) and glucose is an aldohexose. When represented in heterocyclic form, glucose has a pyranose structure, while fructose occurs in both the furanose and pyranose forms, which are in equilibrium, typically about 20% furanose at 20° C. The fructose moiety in sucrose is present as the furanose form.

Any means for cleaving the oxy linkage in sucrose, thereby liberating an equimolar mixture of fructose and glucose moieties can be utilized in the context of this invention. The most rapid means for cleaving this linkage is acid hydrolysis, e.g. with aqueous hydrochloric acid. Although enzymatic hydrolysis is somewhat slower, even at moderately elevated temperatures, it is preferred over acid hydrolysis, as will be explained subsequently. Needless to say, both acid and enzymatic hydrolysis have been used in the art to convert sucrose to monosaccharides. In the context of this invention, where high fructose recovery is the chief objective, mild reaction conditions and high yields (e.g. through lessening of side reactions) are particularly desirable. Enzymatic hydrolysis (e.g. with invertase) can be carried out at a pH of 4.5–6 (hydrochloric or acetic acid-adjusted) and at temperatures ranging from 20° to 60° C. When the temperature exceeds 60° C. enzyme activity is typically reduced, e.g. by about 50%. At 20° C., the reaction may take from one to several days to complete. Accordingly, the preferred practice is to back down from the inactivation temperature of the enzyme just enough to insure full enzyme activity but not enough to significantly slow down the reaction. Thus, typical examples of optimum temperatures would be 50° or 55° C. The amount of enzyme used is dependent upon concentrations in the reaction medium and the reaction period. For example, when 0.05–0.2 parts by weight of invertase are used per 100 parts by weight of sucrose, about 4–12 hours are required for 90 to 100% conversion of the sucrose in a 30–70 Brix molasses solution at 55° C. and 12–24 hours at 25° C. For a reaction time of 3 to 7 hours at 55° C., the invertase dosage would normally be increased to about 0.2–0.4%. (This same dosage requires 10–24 hours to reach 60–90% hydrolysis at 25° C.) The reaction time for acid hydrolysis is considerably shorter (e.g. less than an hour), but reaction conditions are more severe and reversion products are formed. For example, the pH is lower and the temperature somewhat higher as compared to the enzymatic hydrolysis. Typical conditions for an acid-catalyzed hydrolysis of sucrose would be: pH—2 to 3; temperatures of 75°–80° C.; time, approximately 40 minutes. The relatively milder reaction conditions of enzymatic hydrolysis help to minimize color formation and other undesirable effects such as formation of furfural derivatives. Furthermore, less calcium base is needed to form a calcium fructosate precipitate, as no extra acidity is being neutralized. Even crude enzymes (e.g. crude invertase) are effective to achieve hydrolysis, and are thus not unduly expensive, even compared to the common mineral acids.

In addition, enzymatic hydrolysis has the ability to produce free fructose from any sugar possessing a terminal unsubstituted fructose (beta-D-fructofuranoside) moiety. Besides catalytically hydrolyzing sucrose into fructose and glucose, enzymes such as invertase can also hydrolyze raffinose into fructose and melibiose. It has been reported that beet molasses can contain as much as 0.5 to 2% raffinose. If melibiose is an undesirable component of the hydrolyzate, melibiase can be included in the enzyme catalyst, so that the melibiose will be further hydrolyzed into galactose and glucose. Thus, unless the longer hydrolysis times could not be tolerated for commercial or technical reasons, the enzymatic route would typically be used.

The pH of the hydrolysis medium is important and may require some degree of control, and adequate pH adjustment and control can easily be made. (No pH adjustment is ordinarily required for cane molasses.) Hydrochloric or acetic acid are suitable to lower beet molasses pH to approximately 5.5. When the sucrose-containing starting material is molasses, the hydrolyzate product can be conveniently referred to as "inverted molasses" or "invert molasses". Hydrolyzed sucrose is sometimes referred to as "invert sugar", although there may be some confusion of nomenclature here. Some forms of "invert sugar" are highly colored and may contain, on purpose, significant amounts of by-products or degradation products in addition to glucose and fructose. This is particularly true of some "invert sugar" obtained by extreme acid-catalyzed hydrolysis. In the context of this invention, an effort is made to avoid or minimize color formation and the like, since the greatest commercial demand is for a high purity, substantially colorless or white fructose in solid or syrup form, containing a minimum of by-products, thus the importance of the end-purification step.

An important advantage of ultimately obtaining fructose from sucrose involving the intermediate step of sucrose hydrolysis stems from the fact that the monosaccharide product mixture differs from the sucrose starting material by the addition of two atoms of hydrogen and one atom of oxygen. Stated another way, the weight of sugar yield is increased by the addition of a water molecule to the sucrose starting material. For example, 4,277 grams of molasses containing 2,092 grams of sucrose, diluted to 40 Brix with water, yielded the "inverted molasses" content of 1,102 grams of fructose and 1,098 grams of glucose. This means that there was 5% more sugar in the reaction product than in the starting material, the approximately 5% weight increase being due to the addition of 1 water molecule to each sucrose molecule. The cost of water being negligible, 5% of the product is "free", thereby providing a strong economic incentive to produce fructose and glucose from sucrose.

Formation of Calcium-Monosaccharide Complexes

The soluble monosaccharide-containing hydrolyzate (e.g. inverted molasses) is converted to calcium-monosaccharide complexes with a calcium base such as calcium oxide or hydroxide. These complexes vary greatly in solubility, and the difference in solubility between calcium fructosate and calcium glucosate can be advantageously used to separate the two complexes, the calcium-fructose complex being considerably less water soluble especially at low temperatures. This difference in solubility is known in the art and has been used to separate calcium fructosate from mixtures of sugars. (The difficulty comes in liberating the fructose from the fructosate, the traditional carbonation approach having various drawbacks as previously noted.)

The preferred calcium base used to form calcium-monosaccharide complexes is the oxide (quicklime) or hydroxide (slaked lime). Addition of quicklime directly to the hydrolyzate has the advantage of keeping the water in the reaction medium to a minimum and the advantage of minimizing the time available for undesired interaction between the calcium base and atmospheric carbon dioxide. However, the reaction of water and quicklime is exothermic, and, since low reaction temperatures are preferred for calcium-monosaccharide complex formation, it is often more convenient to prereact the quicklime with water to form slaked lime, e.g. 100–500 parts water at 0°–10° C. per 100 parts by weight quicklime, preferably 200–220 parts water. The solubility of slaked lime in water is low, hence a suspension or slurry is typically formed prior to adding the slaked lime to the monosaccharide hydrolyzate.

An additional benefit in preslaking the quicklime is that the exothermic reaction of calcium oxide with water facilitates the formation of very fine, hot particles of calcium hydroxide which tend to form a reasonably uniform slurry. The fresh slaked lime slurry is then cooled somewhat to insure that the calcium-monosaccharide complex formation reaction will take place at moderate temperatures, preferably below room temperature (e.g. below 25° C.), the optimum temperature being below 10° C. Because of the presence of a high concentration of dissolved species in the reaction medium, the freezing point of this medium is considerably below 0° C., and the reaction can be carried out at subzero temperatures. However, such subzero temperatures are not essential, and adequate results can be obtained in the 0°–25° C. range.

Uniformity of addition of the calcium base to the monosaccharide mixture is helpful from a quality control standpoint, since it avoids local excesses of alkalinity which might degrade or transform fructose or fructose moieties into other less desired carbohydrates such as psicose or mannose. Glucose is also sensitive to excess alkalinity, and even neutral solutions can have a degradative effect upon these monosaccharides. Accordingly, direct addition of quicklime (calcium oxide) to the monosaccharides entails a somewhat higher risk of local excesses of alkalinity as well as local excesses of heat due to reaction exotherm. Studies indicate that a slaked lime slurry provides a better yield of fructose. In any event, stirring and cooling both contribute to good reaction control.

Other calcium bases besides calcium oxide and calcium hydroxide are known and could be used. For example, water-soluble calcium salts of weak acids exhibit alkaline behavior in aqueous media. However, calcium oxide and hydroxide are the most readily available on a commercial scale. This is particularly true in beet and cane sugar refining operations which utilize these chemicals.

After the calcium-monosaccharide reaction medium has been thoroughly stirred, cooled and kept at the desired temperature for about an hour or two, crystals of the calcium/fructose complex form in large quantities. The resulting mixture is filtered at relatively low temperatures (typically similar to those at which the reaction took place), preferably under vacuum, and the calcium-monosaccharide complex, in the form of a substantially insoluble filter cake is washed with cold lime water. The best concentrations of "inverted molasses" for liming generally range from 10 to 30 Brix, preferably 15–25 Brix. The preferred mole ratios for reaction of calcium hydroxide and fructose are above 1:1 and generally greater than 1.3:1, e.g. 1.5:1 to about 2.5:1. (A probable stoichiometric model for the reaction calls for two moles of calcium for every mole of fructose.) To insure a complete precipitation of fructose, mole ratios of calcium hydroxide to fructose above 2.5:1 (e.g. 3:1) can be used; however, the excess alkalinity does not, apparently, produce any improvement in fructose yield, but may cause the destruction of the molecule.

The precipitate obtained by reaction of the hydrolyzate (e.g. inverted molasses) with the calcium base typically comprises at least about 85 weight-% calcium-fructose complex, since the fructosate-glucosate ratio in the precipitate is greater than 4:1 and can be as high as, for example 15:1 or even 18.1. It is thus well within the practice of this invention to obtain a solid sugar or an aqueous sugar solution the solids of which comprise at least about 90 weight-% fructose and less than about 10 weight-% glucose.

De-Complexing by Phosphatation

The conditions for the de-complexing reaction should be as mild as reasonably possible in industrial practice. The reaction exotherm will in itself tend to raise the temperature of the reaction medium to moderately high levels (e.g. in excess of 40° C.) absent some effort to cool the reaction mixture or otherwise dissipate the exotherm. Accordingly, the temperature of the reaction medium itself (i.e. the internal temperature as opposed to the ambient temperature) is preferably kept below 40° C., more preferably below room temperature (20°–25° C.). It is also preferable to start the de-complexing reaction as soon as possible after liming. Optimum results are obtained with a reaction medium temperature below 10° C., and a reaction medium temperature of 0° C. can be readily maintained in industrial practice. During de-complexing (phosphatation) both the reactants and the products can have a significant freezing point lowering effect; accordingly, 0° C. is not the lower limit for the reaction temperature—the reaction can be carried out at, for example, −10° or −20° C. However, insofar as industrial practice is concerned, there appears to be no significant advantage to below-zero reaction conditions.

Sufficient orthophosphoric acid is added to bring the pH of the reaction medium below about 10 (preferably below 9), but preferably not below 3. Due to the relatively high stability of the calcium-fructose complex, liberation of fructose may occur less readily at a pH above 9 or 10. More important, the most stable pH for fructose has been reported to be 3.3. Accordingly, a pH value even as low as 7 might be considered too alkaline with respect to the maximum stability of fructose. Surprisingly, the liberated (de-complexed) fructose obtained according to this invention has been found to remain reasonably stable for at least about a day at a pH as high as 8, also found to be the optimum pH for precipitation of calcium phosphate salts of negligible water solubility. The pH range for de-complexing can go below 5.5, particularly if one is not concerned with the nature and yield of the calcium phosphate by-product. A mildly acidic pH (e.g. 5.5 to 7) is the ultimate target for long-term fructose stability with acceptable losses of phosphate precipitation and a pH of 7 to 9 is the target for fair-to-good short-term stability and maximum phosphate precipitation. The risk of fructose instability for the latter target (7–9) can be lessened with a prompt lowering of the pH of the liberated fructose solution through ion exchange (e.g. exchange of $H+$ for $Ca++$) or by other techniques which acidify the fructose solution without solubilizing the calcium phosphate precipitate.

The colorless calcium/monosaccharide cake obtained from the reaction of the sucrose hydrolyzate (e.g. inverted molasses) and the calcium base is preferably dispersed in cold water in order to react efficiently with the orthophosphoric acid. Due to the extremely low water solubility of the calcium/fructose complex, the cake forms a concentrated slurry when dispersed or suspended in cold water. The more concentrated the slurry, the less water there will be in the ultimately obtained fructose solution. Concentrated fructose solutions are preferred, both as an item of commerce in themselves and as in intermediate in the production of solid fructose. Higher fructose concentrations can be obtained by vacuum-evaporation of excess water in the solution or by other mild concentration means, e.g. reverse osmosis.

Depending upon the desired concentration of fructose in the filtrate obtained from the de-complexing reaction, the amount of water slurried with the substantially insoluble complex can range from about 0.1 part by weight per part of complex to about 10:1 water:complex. For convenience of pumping the slurry, the ratio of water to complex should be at least 1:1. For a more concentrated filtrate, the ratio preferably does not exceed 5:1.

The concentration of the orthophosphoric acid used to liberate the fructose from the calcium fructosate complex can also have an effect upon the concentration of fructose in the filtrate obtained from the reaction medium. Dilute phosphoric acid (e.g. 5 to 10% by weight aqueous $H_3PO_4$), while effective in the reaction, adds a great deal of water to the filtrate, thereby diluting the ultimately obtained fructose solution. On the other hand, 100% $H_3PO_4$ or pure phosphorous pentoxide or mixtures of these pure compounds can add to the exotherm, due to the liberation of heat of solution or heat of reaction with water. A workable compromise can be obtained using commercially available feed grade phosphoric acid. An advantage of these commercially available grades of the acid is that they are liquid at normal ambient temperatures and, in some cases, even at the preferred de-complexing reaction temperature (e.g. below 10° C.). At the commercially available concentration of 85 weight-% in water, phosphoric acid is rather viscous, but is still liquid at 20° C. The 50% and 75% concentrations are mobile liquids and are easy to store and pump. Thus, the most preferred phosphoric acid concentration ranges from about 30 to about 80% by weight.

An important benefit of the de-complexing with phosphoric acid is that the calcium phosphate by-product (e.g. "dical") tends to be in the form of a precipitate which has decolorizing properties. Thus, not only is color-forming minimized by the high efficiency of phosphatation under very mild conditions, the relatively low level of color which may be formed in fructose is further reduced by the decolorizing properties of this precipitate (defecation).

The fructose solution obtained from the de-complexing reaction can be useful as is. However, further purification and decolorization of the fructose solution can be accomplished, as will be described subsequently.

A "neutralization" (pH-lowering) treatment of the "basic filtrate" with phosphoric acid or other inexpensive (e.g. mineral) acids is also useful for reducing the dissolved mineral content ("deashing" by chemical precipitation) or obtaining additional useful products or by-products. The "basic filtrate" comprises glucose and fructose in a soluble form along with any other residual materials from the hydrolyzate, e.g. residual organic and inorganic non-sugar substances from inverted molasses. The ratio of soluble glucose to soluble fructose in the basic filtrate generally exceeds 2.5:1 by weight, more typically about 4:1 or 5:1. Accordingly, it is usually practical to neutralize or to acidify the "basic filtrate" (e.g. with $H_3PO_4$ or $H_2SO_4$) and work it up as a low-fructose molasses. If phosphoric acid is used for the "neutralization", the result typically is formation of a gelatinous mixture of generally insoluble calcium phosphate salts co-precipitated with some organic substances (if the sucrose starting material contained non-sugar materials), and some calcium/monosaccharide complex not obtained or precipitated in any previous phosphatation steps. The importance of this "neutralization" step is to prevent glucose (and other saccharides) from decomposition in the highly alkaline medium of the "basic filtrate". It is advisable to carry it out as soon as possible after obtaining the "basic filtrate", and the target pH is about the same as for "de-complexing".

A further filtrate obtained after removal of this gelatinous precipitate typically contains water, water-soluble non-sugar organic materials (if organic materials besides sugars were present in the original starting material), and soluble sugars, particularly glucose and fructose in a ratio of, for example, about 2:1 or 3:1, glucose:fructose. This glucose/fructose mixture can be treated by known techniques to recover more fructose, e.g. chromotography or isomerization or oxidation followed by ion exchange, etc.

Further Purification and Isolation of By-products

The attainment of a reasonably high purity essentially water-insoluble calcium phosphate salt such as "dical" can be accomplished by known drying techniques.

The fructose solution obtained from the de-complexing step, which contains a small amount of dissolved glucose can be further purified and decolorized by conventional techniques such as ion exchange. Ion exchange columns are useful for removing anions such as chloride, sulfate, phosphate, etc. and cations such as sodium, potassium, and calcium. In addition, the fructose/glucose liquor obtained from the de-complexing reaction can, if desired, be further enriched in fructose and lowered in glucose content through known techniques, e.g. careful oxidation (enzymatically) prior to ion exchange. Glucose, being an aldohexose is more susceptible to carboxylic acid (—COOH) formation, which can then be removed by ion exchange. Accordingly, if substantially pure fructose is required, it can be obtained through conversion of —CHO to —COOH groups followed by anion exchange, thereby removing the oxidized aldohexose by-products, contaminants, and diluents. So long as fructose:glucose ratio is about 9:1 or greater, however, further enrichment of the fructose content is not necessary for most purposes, e.g. for crystallization.

The purified fructose solution can be concentrated under vacuum at moderately elevated temperatures, preferably below 40° C., to produce a clear, high-fructose syrup at a pH of about 3 to 4. As noted previously, the ratio of fructose to glucose in this syrup is very high and can be 9:1 or greater. Recovery of solid fructose from the high fructose syrup can be carried out using known crystallization or spray drying techniques. For example, anhydrous crystalline fructose can be crystallized from the syrup using alcohol solvents and crystal seeding techniques. A typical analysis of a crude crystallized sample was found to be 97.5% by weight fructose and 2.5% by weight glucose with 101.3% purity (3% error in enzymatic sugar analysis). Crystallization of fructose from supersaturated fructose-water solution is described in more detail in U.S. Pat. No. 3,928,062, issued Dec. 23, 1975, to Yamauchi.

Spray drying of fructose solutions has been disclosed in U.S. Pat. No. 3,956,009, issued May 11, 1976 to Lundquist et al.

It is ordinarily preferable to concentrate the fructose syrup to a high solids level, e.g. over 75% or even 80 or 85% solids on a dry basis. Additional decolorization after concentration can be achieved by carbon. Also a polish filtration may be used to separate the remaining fines from the decolorized solution. This concentrated syrup is useful in itself as an item of commerce, although it may be more subject to color development, even at room temperature and mildly acidic pH, as compared to spray-dried solid fructose powder or anhydrous fructose crystals. As noted previously, both fructose and glucose are considerably more reactive than the relatively inert sucrose, hence the environment and the form of the fructose can be important.

The principle and practice of this invention is illustrated in the following non-limiting Examples, wherein all parts and percentages are by weight unless otherwise indicated.

EXAMPLE 1

Starting Materials

(A) Beet Molasses 7.7 liters of beet molasses (10390 g) were analyzed and found to contain 5078 g sucrose (48.92%), 5.7 g glucose (0.055%), and 18.68 g fructose (0.18%). The molasses was diluted with 15.3 l of water and the pH was adjusted to 5.5 with 81 ml acetic acid (98%). 7.67 g invertase (from International Enzyme Co., trademark "INVERTASE-IE", activity: 3k) was incubated in 150 ml warm water before it was added into molasses solution. The resulting enzymatically-catalyzed hydrolysis medium was stirred for 4 hours at 55° C. to give complete hydrolysis of sucrose and raffinose. The 22.5 l of "invert molasses" thereby obtained contained 2750 g fructose and 2679 g glucose. The monosaccharide hydrolyzate was suitable for liming and liberation (by phosphatation) of free fructose. The slightly higher fructose content was believed to result from raffinose or fructo-furanosides other than sucrose in the molasses.

(B) Sucrose Solution

A substantially pure sucrose solution (400 g/l) was greated with 0.56 g of invertase and acetic acid to pH 5.2. The 400 g of sucrose yielded hydrolyzate of 220.8 g fructose and 223.3 g glucose. This invert sugar was also suitable for liming and phosphatation. The color of starting sucrose was 20 RBU and the resulting invert sugar is 37 RBU with no correction of invertase absorption.

EXAMPLE 2

Recovery of Fructose and Other Products from "Invert Molasses"

The starting material for this Example was 2.6 l of an "invert molasses" (25 Brix) similar to the reaction product of Example 1(A) and it was diluted with water. This quantity "invert molasses" contained 222.12 g fructose and 221.53 g of glucose. To form the calcium-monosaccharide complexes, 96.6 g of CaO was added to 200 ml water in the cold to form a fresh, slaked lime slurry which was then added to the invert molasses. The resulting reaction medium for calcium-monosaccharide complex formation was cooled so as to maintain its temperature within the range of 0° to 10° C. Rapid stirring was used to keep a degree of uniformity in the slurry-like reaction medium. The medium was stirred for 10 minutes and seeded. Then an additional 42 g CaO previously slaked and diluted with 85 ml water was added to bring the total $Ca(OH)_2$ addition up to a molar ratio of 2:1 $Ca(OH)_2$:$C_6H_{12}O_6$. The precipitate was stored at 0° C. for 1.5 hours then it was filtered and washed with cold lime water until free of color.

Thus-washed calcium fructosate cake was slurried in cold water (1.2 l) and neutralized with 130 ml aqueous 42% food-grade phosphoric acid to pH 6.7. The precipitate was filtered and washed to remove traces of dissolved product. The yield of feed grade solid $CaHPO_4.2H_2O$ from this phosphatation step was in excess of 202 g. The filtrate was a high-fructose solution containing 178.14 g fructose and 10.47 g glucose, representing an initial recovery of 80.2% of the fructose in the invert molasses and a fructose:glucose weight ratio of more than 17:1.

Further investigation demonstrated that substantially similar yields of fructose, glucose, and calcium hydrogen phosphate can be obtained on a commercial scale.

The basic filtrate from the liming reactor was investigated by treating it with 185 ml aqueous 42% food-grade phosphoric acid, yielding a gelatinous precipitate which was also washed. The second filtrate obtained from the basic filtrate was a solution containing 93.33 g glucose and 34.73 g fructose. The gelatinous precipitate contained a calcium phosphate salt or salts (substantially $CaHPO_4.2H_2O$), glucose, and organic residues from the molasses. The additional fructose was recoverable by known techniques.

EXAMPLE 3

Separation of Fructose from Invert Sugar

One liter invert sugar (220.8 l fructose, 223.3 l glucose) from I(B) was reacted with 124 g CaO/270 ml $H_2O$ (1.8 $Ca(OH)_2$/l fructose molar ratio) at temperature between 0° to 10° C. After filtering and washing, the calcium fructosate precipitate was suspended in ice water and neutralized with phosphoric acid to give a high fructose solution (182.2 g fructose, 13.4 g glucose). The basic filtrate was also neutralized with phosphoric acid to give a low fructose solution (162.3 g glucose, 3.46 g fructose).

EXAMPLE 4

Crystalline Fructose from High Fructose Syrup 290 g (200 ml) 81 Brix purified and concentrated high fructose syrup (92% fructose, 8% glucose, pH 5.0) was heated and stirred at 50° C. 600 ml absolute ethanol and 50 ml methanol were added slowly with constant stirring and seeded with crystalline beta-D-fructose. After slow cooling, the supersaturated solution was stirred at room temperature for 12 hours and cold temperature for 4 hours. The precipitates were collected and washed with alcohol to give 113 g fine crystal. The analysis of this crystal showed 97.5% by weight fructose and 2.5% by weight glucose.

What is claimed is:

1. A process for obtaining solid fructose or aqueous fructose solutions of at least 85 weight-% fructose purity from a raw material containing a fructofuranoside-type compound, said fructofuranoside-type compound including glucose monomer, said process comprising the steps of:

(a) hydrolyzing the fructofuranoside-type compound in said raw material to obtain an aqueous solution containing a hydrolyzate, said hydrolyzate comprising glucose and fructose monosaccharide hydrolysis products;

(b) adding a calcium base to precipitate a mixture of calcium-sugar complexes, said mixture comprising at least about 85 weight-% calcium-fructose complex;

(c) treating the calcium fructose complex obtained in step (b) with phosphoric acid in an aqueous reaction medium under temperature conditions sufficiently cool to avoid raising the temperature of said reaction medium, due to the reaction exotherm, above 40° C.; and maximizing the recovery of calcium phosphate precipitate by keeping the pH within the range of about 7 to about 9;

(d) recovering from the reaction products of step (c) said calcium phosphate precipitate and an aqueous sugar solution, the solids of said solution comprising at least 85 weight-% fructose;

(e) lowering the pH of said aqueous sugar solution to less than about 7 but greater than about 3.

2. A process according to claim 1 wherein the calcium base is selected from the group consisting of aqueous calcium hydroxide and dry calcium oxide.

3. A process according to claim 1 wherein said step (e) is carried out by replacement of $Ca^{++}$ with $H^{+}$ with an ion exchange means.

4. A process according to claim 1 wherein the calcium phosphate precipitate comprises $CaHPO_4$ or a hydrate thereof.

5. A process according to claim 4 wherein the recovery of said precipitate is maximized by treating the calcium fructose complex with sufficient phosphoric acid to lower the pH to about 8.

6. A process according to claim 1 wherein said steps (b) and (c) are carried out at reaction medium temperatures below about 20° C.

7. A process according to claim 6 wherein said raw material comprises molasses.

8. A process according to claim 7 wherein said molasses contains raffinose which is also hydrolyzed to produce fructose in said step (a).

9. A process for obtaining solid fructose of at least about 90 weight-% purity from cane or beet molasses, comprising the steps of:

(a) enzymatically hydrolyzing the sucrose in said molasses with invertase to obtain a treated molasses containing a hydrolyzate comprising at least one mole of fructose per mole of glucose;

(b) adding an aqueous slurry comprising calcium hydroxide to said treated molasses to form a precipitated mixture of calcium-sugar complexes consisting essentially of at least about 90 weight-% calcium fructosate and less than about 10 weight-% calcium glucosate;

(c) removing said precipitated mixture from the resulting fructose-depleted, glucose-enriched molasses to recover both said precipitated mixture and said fructose-depleted, glucose-enriched molasses;

(d) blending said precipitated mixture with water to form an aqueous reaction medium;

(e) adding sufficient phosphoric acid to said aqueous reaction medium to lower the pH thereof below 10 but above 7 and cooling said reaction medium to a temperature below about 20° C., thereby obtaining (1) a phosphate-containing precipitate comprising a calcium phosphate salt and entrapped color bodies and (2) an aqueous solution containing dissolved sugars comprising at least about 90 weight-% fructose and less than about 10 weight-% glucose;

(f) separating said phosphate-containing precipitate from said aqueous solution containing dissolved sugars; and (g) further lowering the pH of said aqueous solution of dissolved sugars to below 7 but above 3.

10. A process according to claim 9 comprising the additional step of recovering solid fructose of at least 90 weight-% purity from the aqueous solution of dissolved sugars.

11. A process according to claim 9 wherein said fructose-depleted, glucose-enriched molasses is acidified with a mineral acid.

12. A process according to claim 9 wherein said step (g) is carried out by replacement of $Ca^{++}$ with $H^{+}$ in said aqueous solution of dissolved sugars, using an ion exchange means.

* * * * *